United States Patent [19]

Bachand et al.

[11] Patent Number: 4,996,896

[45] Date of Patent: Mar. 5, 1991

[54] DUAL USE SCREWDRIVER

[76] Inventors: Armand Bachand, 46 Woodland Ave., Southbridge, Mass. 01550; Wayne Morin, 28 Beach St., Sturbridge, Mass. 01566

[21] Appl. No.: 490,924

[22] Filed: Mar. 9, 1990

[51] Int. Cl.[5] ..... B25B 23/00

[52] U.S. Cl. ..... 81/450; 81/177.7; 81/489

[58] Field of Search ..... 81/124.5, 177.5–177.7, 81/177.8, 439, 440, 450, 489

[56] References Cited

U.S. PATENT DOCUMENTS 821,328 5/1906 Bartlett ..... 81/450 X 1,215,308 2/1917 Johnson ..... 81/440 X 3,773,094 11/1973 Kuenzel ..... 81/177.8 X 4,815,346 3/1989 Littlehorn ..... 81/440 X

*Primary Examiner*—James G. Smith

*Attorney, Agent, or Firm*—Charles R. Fay

[57] ABSTRACT

A screwdriver having a handle, locking sleeve, and blade, the blade being pivotally connected at the center of the handle, the blade having the ability to be pivoted from the basic in-line operating position relative to the handle to a second operating position at ninety degrees to the usual longitudinal position. The sleeve aids in maintaining the desired position of the blade and handle.

8 Claims, 2 Drawing Sheets

FIG. 1
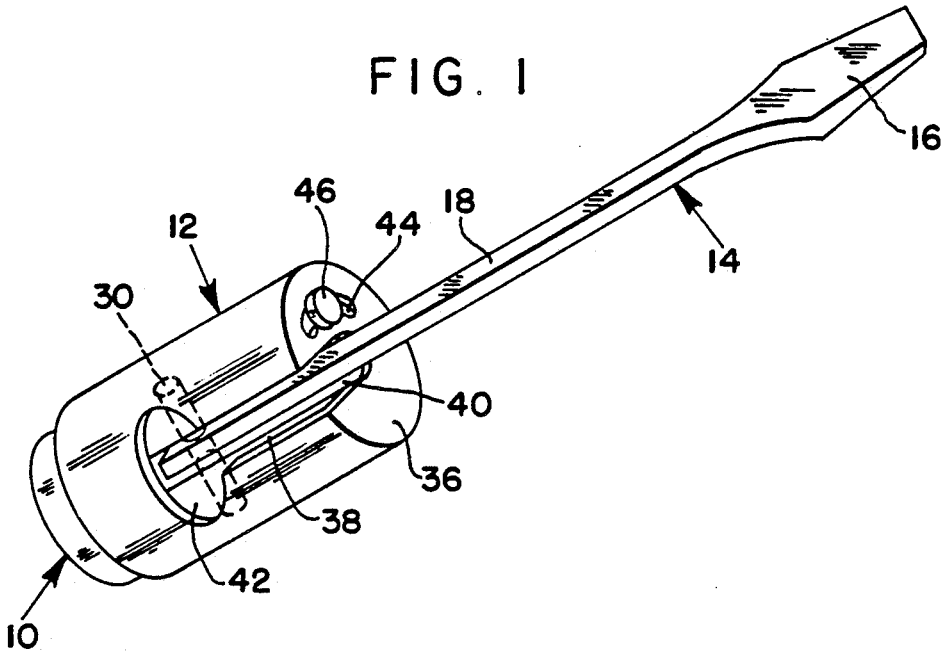
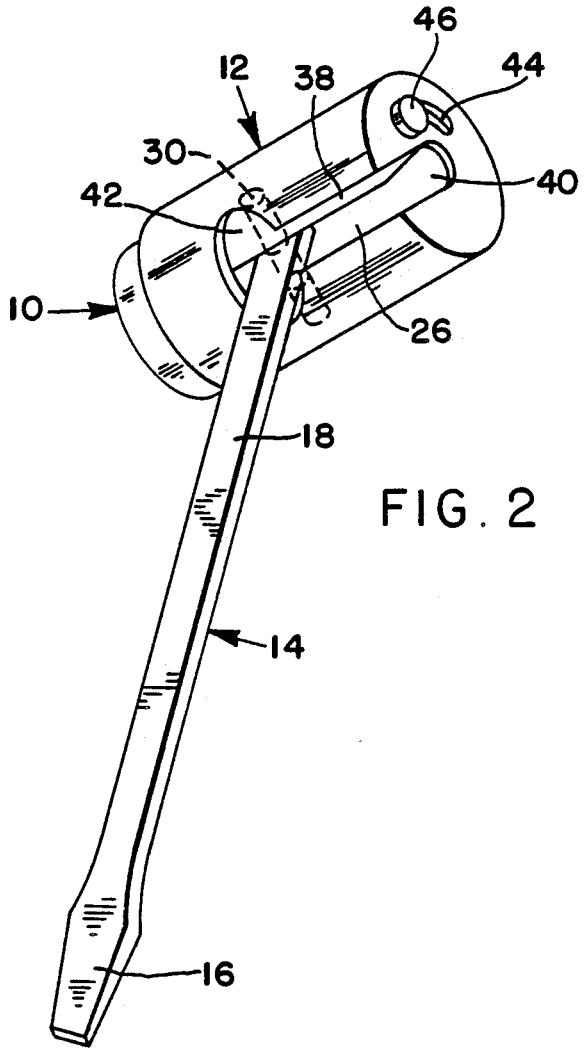
FIG. 2

DUAL USE SCREWDRIVER

BACKGROUND OF THE INVENTION

Screwdrivers are presently available in several sizes and types. These include the basic straight-blade screwdriver with different type bits, Phillips head, slotted, etc. and with separate, changeable bits; also there is the fixed position "T" handle socket and hex head screwdrivers. While working with a common screwdriver the occasion will arise when extra torque is needed to loosen stuck fasteners. A search is then required to appropriate a pair of pliers, the locking type preferably to fasten to the screwdriver blade, creating a radial handle to exert the additional leverage required to loosen the stuck fastener. A fixed position "T" handle screwdriver is an extra tool needed to keep on hand for such emergencies. This invention provides the capacity to use the necessary torque when required with the mere twist of the handle relative to the blade, solving the problem by using the tool at hand with no search for additional tools needed.

SUMMARY OF THE DISCLOSURE

A sleeve, closed at one end and open at the other end is cylindrical and receives a like-shaped core therein that preferably extends out of the open end of the sleeve to a small extent. There is a radial slot in the core that extends through the end of the core to the closed end of the sleeve from about midway of the ends of the core which may be solid otherwise, and the sleeve has a corresponding slot longitudinally thereof that extends into the closed end of the sleeve, with small extensions circumferentially of the sleeve at the inner end of the sleeve slot adjacent the inner end of the core slot.

The butt or non-working end of a screwdriver is located in the core slot, the shaft extending out of the core longitudinally and axially thereof, and the butt end is held in the slot as by any kind of cross pin or the like, so that the entire screwdriver can pivot on the pin out the core slot, into a ninety degree position radially of the core. The sleeve is set onto the core so that the screwdriver end extends out through the part of the sleeve slot in the end of the sleeve. The sleeve is rotatable on the core, so that the slots coincide or not, depending on the users manual positioning of the parts. When the slots do not coincide the screwdriver is trapped in normal, axial extension of the core plus sleeve handle, but when the slots coincide, the screwdriver can be pivoted out to its radial position, and locked by an additional short rotation of the sleeve, locking the screwdriver shank by being entered into one of the short circumferential slots in the sleeve.

A lock is provided for the double purpose of locking the sleeve to the core against both axial and excess rotational relative motion of the sleeve and core and this may be a simple headed screw or pin passing through an arced slot in the closed end of the sleeve and into the core, thereby limiting the rotary motion of the parts as well as holding sleeve and core to each other.

BRIEF DESCRIPTION OF THE DRAWING

FIG. 1 is a perspective view showing a screwdriver in standard position;

FIG. 2 is a like view showing the screwdriver in "T" or extra torque position.

PREFERRED EMBODIMENT OF THE INVENTION

Figure 3:
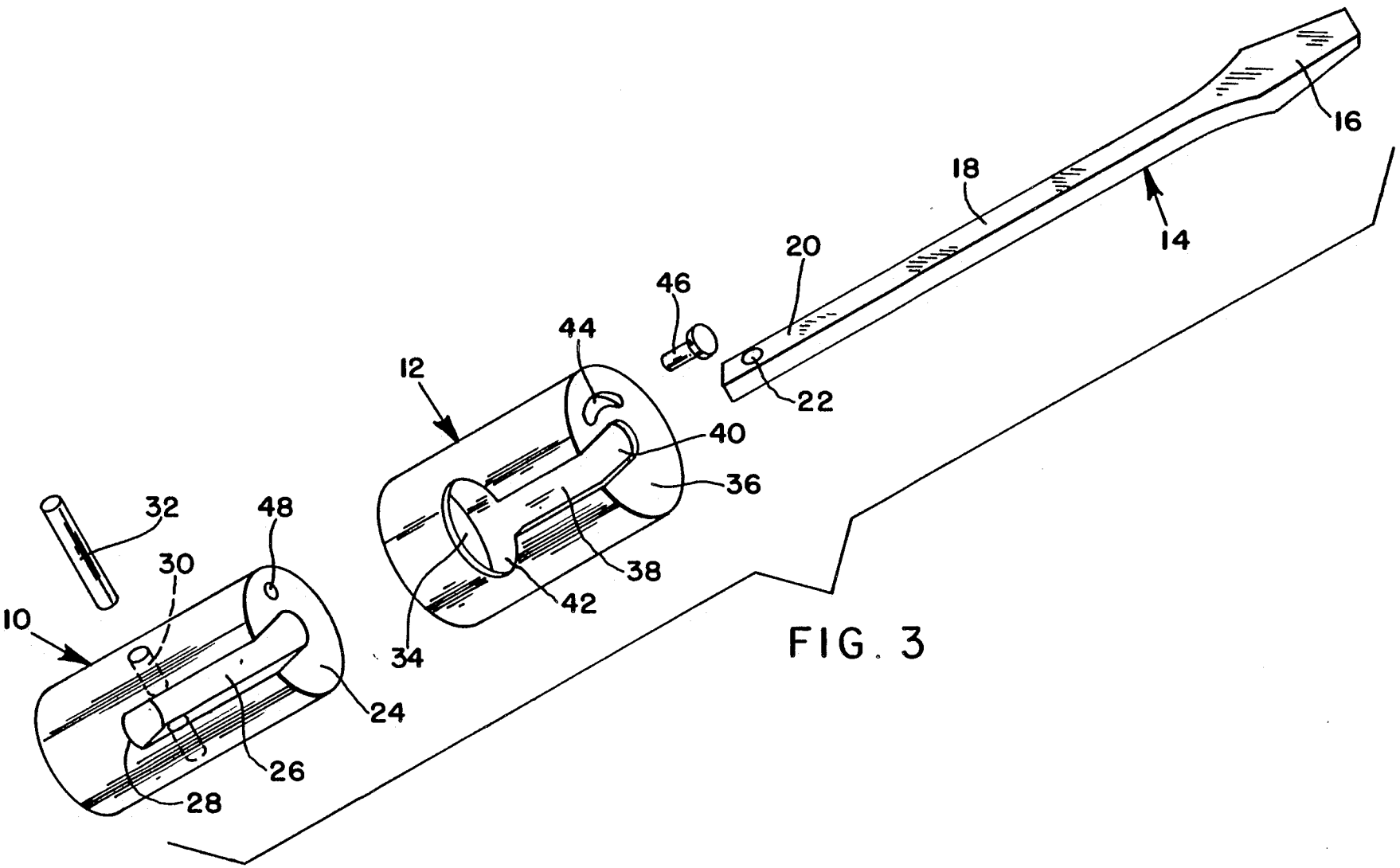
FIG. 3 is an exploded view of the parts of the device, in perspective.

The screwdriver or other tool of this invention comprises a cylindrical core 10, a corresponding cylindrical sleeve 12, and a tool such as a screwdriver or socket wrench or the like 14. The tool per se has a distil operative end 16, shank 18, and a handle securement proximate end 20 with a through pin hole 22 in it.

The core has an end 24 and a surface longitudinal slot or channel 26 that intersects the end 24 of the core and extends inwardly from end 24 to a point 28 intermediate the ends of the core. Point 28 defines the inner end of slot or channel 26 adjacent which is a cross pin hole 30 to receive a split pin 32 and to pass through hole 22 in the shank of tool 14, thus pivotally anchoring the tool to the core.

The sleeve 12 has an open end 34 and a closed end 36 and it can be slid down over the core by reason of the open end. The sleeve 12, closed end 36 abuts or substantially abuts the end 24 of the core. Sleeve 12 has a longitudinal slot 38 in general conformity to slot 26, and slot 38 extends into sleeve closed end 36, as at 40, to accommodate the tool shank when in the position of FIG. 1, wherein the screwdriver will be used in the customary manner. At its inner end slot 38 has a cross slot 42 at each side of slot 28. Also in its closed end 36, the sleeve has an arc shaped slot 44 accommodating a headed fastener 46 that takes into the end 24 of the core, as into a corresponding hole 48. The cross slot 42 accommodates shank 14 as in FIG. 2, and the edge portions of slot 38 lock the shank in position.

With this construction, the screwdriver can convert to a "T" handle when additional torque is required. By rotating the handle sleeve 12 slightly and aligning the slots in the handle sleeve with the slot 26 in the handle core 10 the screwdriver blade is allowed to pivot 90 degrees from the standard position. Another slight rotation of the handle sleeve locks the blade into the "T" position. To return the blade to the standard screwdriver position simply rotate the handle sleeve in the opposite direction from the previous movement and pull the blade back down. The final rotation of the handle sleeve in either direction locks the blade into operating position.

The fastener 46 in slot 44, limits rotary motion and retains the core in the sleeve.

We claim:

1. A dual use screwdriver comprising a handle and a screwdriver shank and means pivoting the shank to the handle, said handle comprising an inner core and an exterior sleeve for the core, said sleeve having an open end and a closed end, said sleeve and said core being cylindrical and the core fitting inside the sleeve, the core being rotatable to a small degree in said sleeve, said core having an outer surface, opposite ends and a core center, a longitudinal slot in the surface of the core, said slot transecting one end of the core and terminating adjacent the core center, means pivoting the shank of the screwdriver adjacent the core center and in the slot, the screwdriver having two operative positions, one of which is axially longitudinally extending from the core at said one end of the core, and the other being radial of the core, the core acting as a part of the operative handle for the screwdriver in both positions, a slot in the sleeve generally co-terminous with the core slot and extending into the closed end of the sleeve, said slots being arranged to coincide or selectively to close the core slot by said sleeve when the sleeve is rotated relative to the core, and the shank of the screwdriver being pivotable from either position to the other when the slots coincide, and a relatively short cross slot in the sleeve adjacent the sleeve end thereof remote from the closed end of the sleeve, said cross slot accomodating the shank of the screwdriver when the slots are in offset position relative to each other and maintaining the screwdriver in its radial position, and means securing the core and sleeve and limiting the degree of relative rotation thereof.

2. The screwdriver of claim 1 wherein said means securing the core and sleeve and limiting the degree of relative rotation thereof comprises an arced slot in the closed end of the sleeve and a headed member extending through the arced slot into the core.

3. The screwdriver of claim 1 wherein the core extends outwardly of the sleeve at the open end of the sleeve.

4. A dual purpose tool for turning an object in a rotary manner, said tool comprising a shank having an operative end and an opposite end for attachment to a handle, a handle comprising a cylindrical core and a cylindrical sleeve fitting the core for rotary motion with respect thereto, the core having opposite ends, an outer surface, and a longitudinal surface slot extending from one end to an intermediate location on the core, a pin in said shank adjacent said opposite end of the shank and transecting said slot so that a portion of the shank is receivable in the slot and has at least two operative positions by pivoting on said pin as an axis, said sleeve having an open end and a closed end and a longitudinal slot extending from a point near the pin to the closed end and extending radially into the closed end of the sleeve, the longitudinal slots of said core and of said sleeve coinciding in one rotated position of said sleeve relative to said core to allow the tool shank to pivot, and said longitudinal slots being selectively offset in another rotated position of said sleeve relative to said core to trap the tool shank in either of said two operative positions, and means to secure the sleeve and core together while at the same time allowing relative rotation of the sleeve and core to secure the tool shank or to release it, said means to secure the sleeve and core together comprising an arced slot in the sleeve closed end and a headed fastener extending through the arced slot into the core.

5. The tool of claim 4 including means in the sleeve slot adjacent the pin in the core to accommodate the tool shank in radial position relative to the handle.

6. A dual use tool comprising a cylindrical sleeve closed at one end, a cylindrical core fitting in the sleeve for relative rotational motion of sleeve and core about a common axis, generally similar surface slots cooperatively arranged on the sleeve and core, said slots being longitudinal of the sleeve and core, a tool having a shank with a proximate end swingingly associated with the core and having operable positions in axial extension of the sleeve and core and radially thereof, the tool shank being in the slot of the core in axial position and extending out through the sleeve slot in radial position, the relative rotary action of the sleeve and core serving to hold the shank in either one of the positions thereof by means of having the slots mis-aligned in operative tool positions and aligned in the non-operative motions of the tool shank between positions, and means to limit the amount of rotation of the sleeve relative to the core.

7. The tool of claim 6 including means to hold the sleeve to the core.

8. A dual use tool comprising a cylindrical sleeve closed at one end, a cylindrical core fitting in the sleeve for relative rotational motion of sleeve and core about a common axis, generally similar surface slots cooperatively arranged on the sleeve and core, said slots being longitudinal of the sleeve and core, a tool having a shank with a proximate end swingingly associated with the core and having operable positions in axial extension of the sleeve and core and radially thereof, the tool shank being in the slot of the core in axial position and extending out through the sleeve slot in radial position, the relative rotary action of the sleeve and core serving to hold the shank in either one of the positions thereof by means of having the slots mis-aligned in operative tool positions and aligned in the non-operative motion of the tool shank between positions, an arched slot in the closed end of the sleeve and a headed fastener passing through the arched slot and engaged with the core.

* * * * *